US006598383B1

(12) United States Patent
Vandervort et al.

(10) Patent No.: US 6,598,383 B1
(45) Date of Patent: Jul. 29, 2003

(54) FUEL SYSTEM CONFIGURATION AND METHOD FOR STAGING FUEL FOR GAS TURBINES UTILIZING BOTH GASEOUS AND LIQUID FUELS

(75) Inventors: Christian L. Vandervort, Voorheesville, NY (US); Richard S. Bourgeois, Albany, NY (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/456,864

(22) Filed: Dec. 8, 1999

(51) Int. Cl.[7] ..... F02C 7/26
(52) U.S. Cl. ..... 60/39.03; 60/39.06
(58) Field of Search ..... 60/39.03, 39.06

(56) References Cited

U.S. PATENT DOCUMENTS 4,292,801 A * 10/1981 Wilkes et al. ..... 60/39.06
5,121,597 A * 6/1992 Urushidani et al. ..... 60/39.06
5,259,184 A 11/1993 Borkowicz et al.
5,359,847 A * 11/1994 Pillsbury et al. ..... 60/39.06
5,491,970 A 2/1996 Davis, Jr.
5,575,153 A * 11/1996 Ito et al. ..... 60/737
5,640,841 A * 6/1997 Crosby ..... 60/39.06
5,660,045 A 8/1997 Ito et al.
5,722,230 A 3/1998 Cohen et al.
5,729,968 A 3/1998 Cohen et al.
5,836,164 A 11/1998 Tsukahara et al.
5,901,549 A * 5/1999 Mandai et al. ..... 60/39.06

OTHER PUBLICATIONS

L.B. Davis; *Dry Low $NO_x$ Combustion Systems for GE Heavy–Duty Gas Turbines*; pp 1–15.

* cited by examiner

*Primary Examiner*—Charles G. Freay
*Assistant Examiner*—David J. Torrante
(74) *Attorney, Agent, or Firm*—Nixon & Vanderhye

(57) ABSTRACT

A nozzle configuration and control methodology adapted to provide a compact means for configuring and operating an industrial gas turbine on either gaseous or liquid fuel while utilizing fuel staging to achieve very low emissions. More specifically, the outer fuel nozzles are used for delivery of a portion of the premix gaseous fuel and all liquid fuel, but not diffusion gaseous fuel. Water injection for emissions control on liquid fuel and atomizing air for the liquid fuel are also supplied entirely by the outer fuel nozzles. The central fuel nozzle is thus used for the supply of both premix gaseous fuel and all diffusion gaseous fuel. The disclosed configuration reduces the number of required fluid passages thus simplifying the endcover structure while enabling fuel staging to achieve very low emissions on gaseous fuel.

4 Claims, 5 Drawing Sheets

SRV SPEED/RATIO VALVE
GCV1 GAS CONTROL 1DIFF
GCV2 GAS CONTROL 1PM
GCV3 GAS CONTROL 5PM
GCV4 GAS CONTROL Q

5PM – 5 NOZ. PRE–MIX ONLY
1DIFF – CTR. NOZ. DIFFUSION
1PM – CTR. NOZ. PRE–MIX
Q – QUAT MANIFOLD, CASING, PRE–MIX ONLY

FUEL SYSTEM CONFIGURATION AND METHOD FOR STAGING FUEL FOR GAS TURBINES UTILIZING BOTH GASEOUS AND LIQUID FUELS

BACKGROUND OF THE INVENTION

The present invention relates to gas and liquid fueled turbines and, more particularly, to methods of operating combustors having multiple nozzles for use in a turbine wherein the nozzles are staged between different modes of operation, and to the compact configuration that may be realized therewith.

Dry Low NOx technology is routinely applied for emissions control with gaseous fuel combustion in industrial gas turbines with can-annular combustion systems through utilization of premixing of fuel and air. The primary benefit of premixing is to provide a uniform rate of combustion resulting in relatively constant reaction zone temperatures. Through careful air management, these temperatures can be optimized to produce very low emissions of oxides of nitrogen (NOx), carbon monoxide (CO), and unburned hydrocarbons (UHC). Modulation of a center premix fuel nozzle can expand the range of operation by allowing the fuel-air ratio and corresponding reaction rates of the outer nozzles to remain relatively constant while varying the fuel input into the machine. Detailed methods for controlling or operating such a machine on natural gas are described for example in Davis, Dry Low NOx Combustion Systems For GE Heavy-Duty Gas Turbines, GER-3568F, 1996 and in U.S. Pat. Nos. 5,722,230 and 5,729,968, the disclosures of which are incorporated herein by this reference.

Liquid fuel is commonly supplied in industrial gas turbines with diluent injection for emissions control from approximately 50 to 100 percent of rated load. Water or steam is generally used as the diluent. Combustors with capability of operating on either gaseous or liquid fuels are well established and examples thereof are described in the aforementioned publications.

The problems associated with dual fuel machines include the packaging requirements associated with locating a number of fluid passages within a limited volume and the development of an effective methodology to control the operation of the machine while meeting the ever-lower emissions levels required by environmental agencies throughout the world. Solving these problems is of particular difficulty for small industrial gas turbines with can-annular combustion systems with lower than 35 Megawatts power output.

BRIEF SUMMARY OF THE INVENTION

The nozzle configuration and control methodology of the invention is adapted to provide a compact means for configuring and operating an industrial gas turbine on either gaseous or liquid fuel while utilizing fuel staging to achieve very low emissions. More specifically, the invention is embodied in a configuration and operational methodology wherein the outer fuel nozzles are used for delivery of a portion of the premix gaseous fuel and all liquid fuel. Water injection for emissions control when operating on liquid fuel and atomizing air are also supplied entirely by the outer fuel nozzles. The central fuel nozzle is thus reserved for the supply of both premix gaseous fuel and diffusion gaseous fuel.

Thus, the invention is embodied in a gas turbine in which a plurality of combustors are provided, each having a plurality of outer fuel nozzles, e.g. from three to six, arranged about a longitudinal axis of the combustor, a center nozzle disposed substantially along the longitudinal axis, and a single combustion zone. Each outer fuel nozzle has at least one premix gas passage connected to at least one premix gas inlet and communicating with a plurality of radially extending premix fuel injectors disposed within a dedicated premix tube adapted to mix premix fuel and combustion air prior to entry into the single combustion zone located downstream of the premix tube. The center nozzle also has at least one premix gas passage connected to at least one premix gas inlet and communicating with a plurality of radially extending premix fuel injectors disposed within a dedicated premix tube adapted to mix premix fuel and combustion air prior to entry into the single combustion zone located downstream of the premix tube. The center nozzle further has a diffusion gas passage connected to a diffusion gas inlet. The diffusion gas passage terminates at a forwardmost discharge end of the center fuel nozzle downstream of the premix fuel injectors but within the dedicated premix tube.

The invention is further embodied in a method of operating a combustor wherein the combustor has a plurality of outer fuel nozzles in an annular array arranged about a center axis and a center nozzle located on the center axis, and wherein the annular array is selectively supplied with premix fuel, liquid fuel, water and atomizing air, and further wherein the center nozzle is selectively supplied with diffusion fuel and premix fuel, the method comprising the steps of:

a) at start-up, supplying the center fuel nozzle with diffusion fuel;

b) as the unit load is raised, supplying premix fuel to at least one of the outer nozzles in the annular array;

c) at part load, ceasing diffusion fuel flow to the center nozzle;

d) as load is further increased, initiating premix fuel supply to the center nozzle without adding to the supply of premix fuel to the outer fuel nozzles in the annular array; and then e) supplying additional premix fuel to all of the outer fuel nozzles in the annular array and to the center nozzle as the turbine load increases.

BRIEF DESCRIPTION OF THE DRAWINGS

These, as well as other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Requirements for dual fuel capability can result in considerable complexity because of the number of flow passages required. Moreover, stringent emissions requirements for gas turbine power plants force utilization of Dry Low NOx, or DLN systems, for combustion of natural gas. These DLN systems typically supply fuel gas to three or more locations within the combustion system in order to meet specifications for emissions, load variation (turndown), metal hardware temperatures, and acceptable combustion acoustic dynamics.

Figure 1:
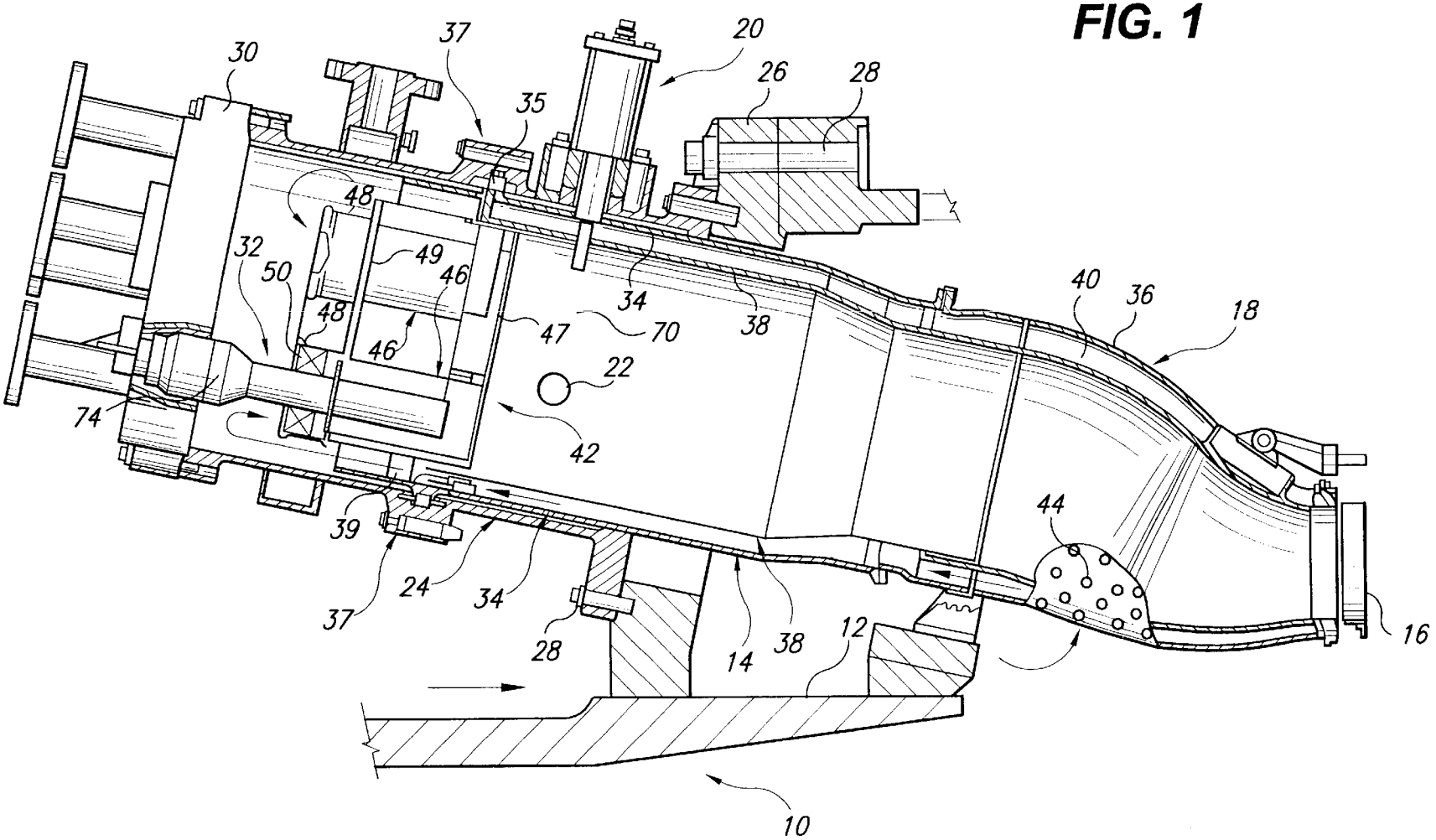
FIG. 1 is a schematic cross-sectional view through one of the combustors of a turbine in accordance with an exemplary embodiment of the invention.

This invention provides a compact means for configuring and operating an industrial gas turbine on gaseous and/or liquid fuels while utilizing fuel staging to achieve very low emissions on gaseous fuel. The system comprising this invention is a part of one (each) combustor assembly arranged in a can-annular configuration on an industrial gas turbine. In gas turbines with can-annular combustor configurations, a series of combustion chambers or cans are located around the circumference of the machine and gas and liquid fuel nozzles are disposed in the combustion chambers to direct fuel to various locations therewithin. FIG. 1 is a schematic cross-sectional view through one of the combustors of such a turbine, in which the system of the invention is advantageously incorporated.

The gas turbine 10 includes a compressor 12 (partially shown), a plurality of combustors 14 (one shown), and a turbine represented here by a single blade 16. Although not specifically shown, the turbine is drivingly connected to the compressor 12 along a common axis. The compressor 12 pressurizes inlet air which is then reverse flowed to the combustor 14 where it is used to cool the combustor and to provide air to the combustion process.

As noted above, the gas turbine includes a plurality of combustors 14 located about the periphery of the gas turbine. A double-walled transition duct 18 connects the outlet end of each combustor with the inlet end of the turbine to deliver the hot products of combustion to the turbine. Ignition is achieved in the various combustors 14 by means of spark plug 20 in conjunction with cross fire tubes 22 (one shown) in the usual manner.

Each combustor 14 includes a substantially cylindrical combustion casing 24 which is secured at an open forward end to the turbine casing 26 by means of bolts 28. The rearward or proximal end of the combustion casing is closed by an end cover assembly 30 which includes supply tubes, manifolds and associated valves for feeding gaseous fuel, liquid fuel, air and water to the combustor as described in greater detail below. The end cover assembly 30 receives a plurality (for example, three to six) "outer" fuel nozzle assemblies 32 (only one shown in FIG. 1 for purposes of convenience and clarity), arranged in a circular array about a longitudinal axis of the combustor, and one center nozzle 33 (see FIG. 2).

Within the combustor casing 24, there is mounted, in substantially concentric relation thereto, a substantially cylindrical flow sleeve 34 which connects at its forward end to the outer wall 36 of the double walled transition duct 18. The flow sleeve 34 is connected at its rearward end by means of a radial flange 35 to the combustor casing 24 at a butt joint 37 where fore and aft sections of the combustor casing 24 are joined.

Within the flow sleeve 34, there is a concentrically arranged combustion liner 38 which is connected at its forward end with the inner wall 40 of the transition duct 18. The rearward end of the combustion liner 38 is supported by a combustion liner cap assembly 42 which is, in turn, supported within the combustor casing by a plurality of struts 39 and an associated mounting assembly (not shown in detail). Outer wall 36 of the transition duct 18 and that portion of flow sleeve 34 extending forward of the location where the combustion casing 24 is bolted to the turbine casing (by bolts 28) are formed with an array of apertures 44 over their respective peripheral surfaces to permit air to reverse flow from the compressor 12 through the apertures 44 into the annular space between the flow sleeve 34 and the liner 38 toward the upstream or rearward end of the combustor (as indicated by the flow arrows shown in FIG. 1).

The combustion liner cap assembly 42 supports a plurality of premix tubes 46, one for each fuel nozzle assembly 32, 33. More specifically, each premix tube 46 is supported within the combustion liner cap assembly 42 at its forward and rearward ends by front and rear plates 47, 49, respectively, each provided with openings aligned with the open-ended premix tubes 46. The front plate 47 (an impingement plate provided with an array of cooling apertures) may be shielded from the thermal radiation of the combustor flame by shield plates (not shown).

The rear plate 49 mounts a plurality of rearwardly extending floating collars 48 (one for each premix tube 46, arranged in substantial alignment with the openings in the rear plate), each of which supports an air swirler 50 in surrounding relation to a radially outermost wall of the respective nozzle assembly. The arrangement is such that air flowing in the annular space between the liner 38 and flow sleeve 34 is forced to again reverse direction in the rearward end of the combustor (between the end cap assembly 30 and sleeve cap assembly 44) and to flow through the swirlers 50 and premix tubes 46 before entering the burning or combustion zone 70 within the liner 38, downstream of the premix tubes 46. The construction details of the combustion liner cap assembly 42, the manner in which the liner cap assembly is supported within the combustion casing, and the manner in which the premix tubes 46 are supported in the liner cap assembly in the subject of U.S. Pat. No. 5,259,184, incorporated herein by reference.

Figure 2:
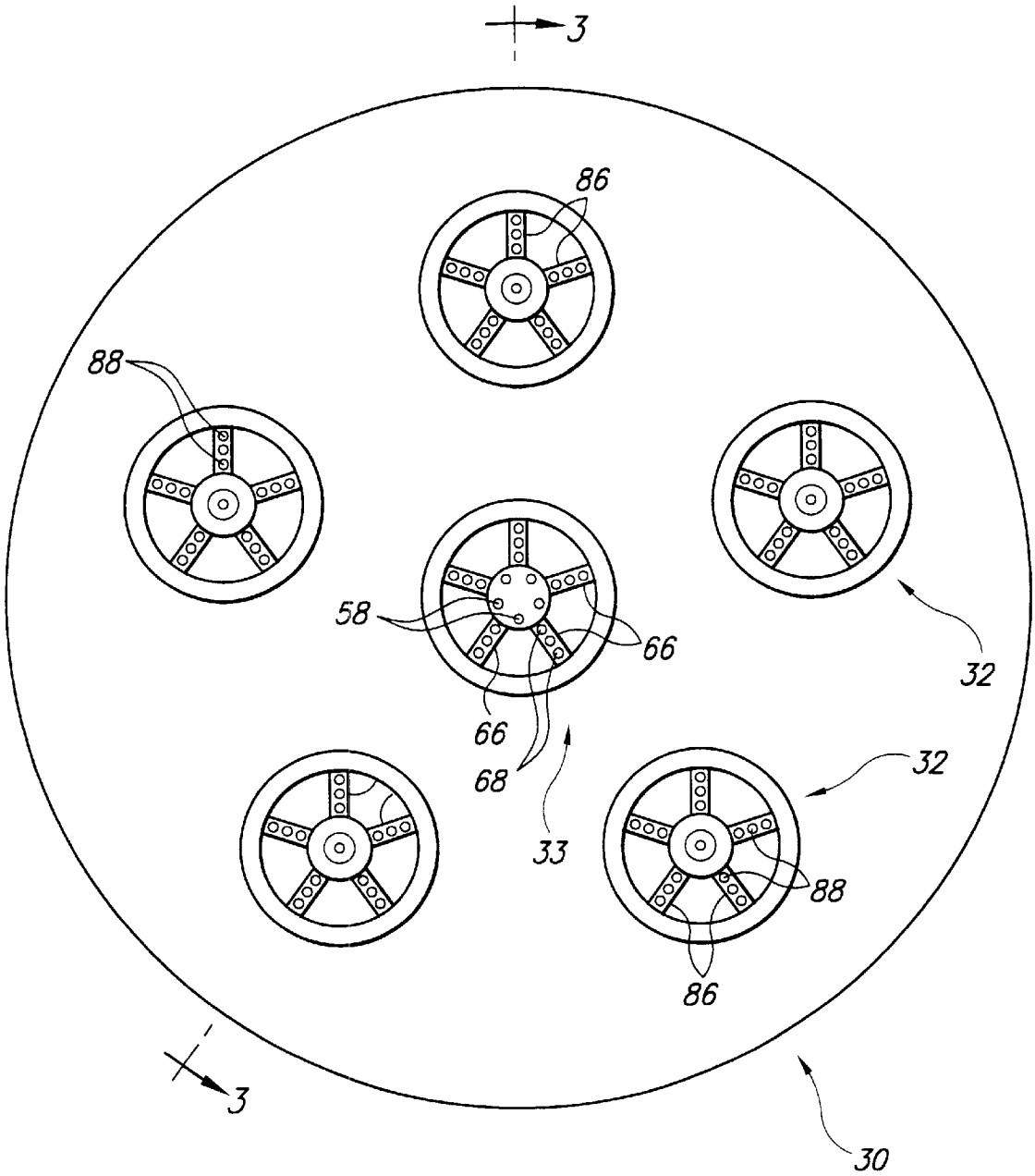
FIG. 2 is a schematic front end view of an end cover and fuel nozzle assembly embodying the invention.
Figure 3:
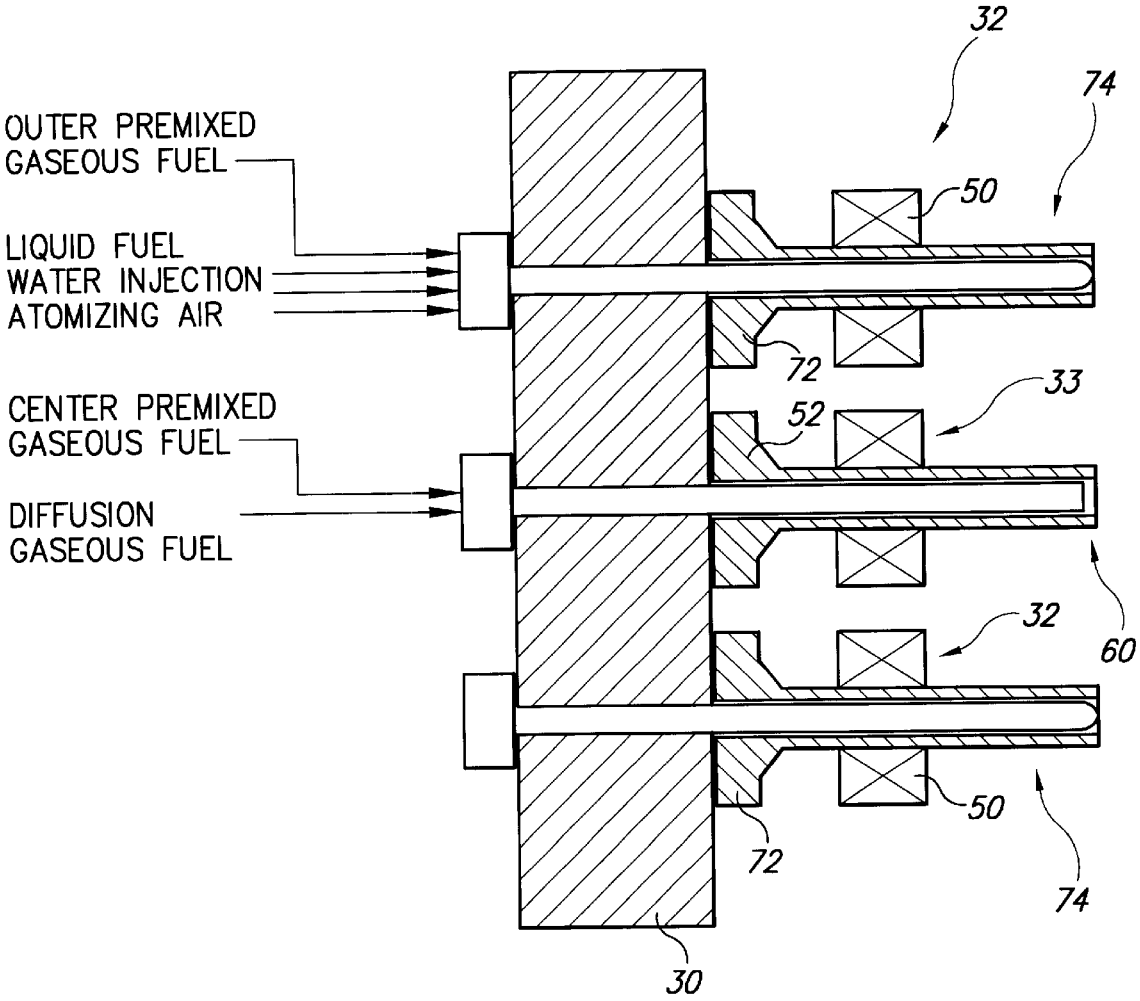
FIG. 3 is a schematic cross-sectional view of an end cover and fuel nozzle assembly taken along line 3—3 in FIG. 2.

As noted above, the system comprising this invention is a part of one (each) combustor assembly arranged in a can-annular configuration on an industrial gas turbine. The system provides outer fuel nozzles 32 and a center fuel nozzle 33, all attached to endcover 30. The endcover 30 contains internal passages which supply the gaseous and liquid fuel, water, and atomizing air to the nozzles as detailed below. Piping and tubing for supply of the various fluids are in turn connected to the outer surface of the endcover assembly. FIGS. 2 and 3 schematically show the proposed endcover arrangement wherein the outer nozzles supply both premix gaseous fuel and liquid fuel, as well as water injection and atomizing air, and the center nozzle 33 is adapted to supply diffusion gaseous fuel centrally and premix gaseous fuel radially.

Figure 5:
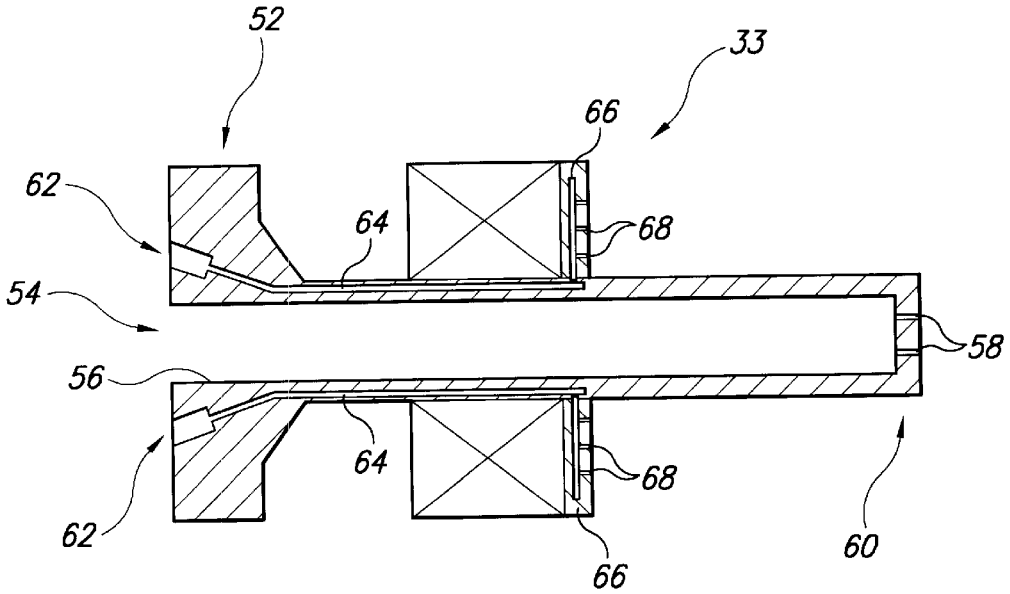
FIG. 5 is a schematic cross-sectional view of a center fuel nozzle embodying the invention.

More specifically, the gas nozzles are configured in a manner so as to provide from 4 to 6 radially outer nozzles 32 and one center nozzle 33. In the present preferred embodiment of the invention, the outer nozzles and the center gas nozzle all provide premix gaseous fuel. The center nozzle 33, only, provides gaseous diffusion fuel. Thus, referring to FIGS. 2, 3 and 5, the center fuel nozzle assembly 33 includes a proximal end or rearward supply section 52 with a diffusion gas inlet 54 for receiving diffusion gas fuel into a respective passage 56 that extends through the center nozzle assembly. The central passage supplies diffusion gas to the burning zone 70 of the combustor via orifices 58 defined at the forwardmost end 60 of the center fuel nozzle assembly 33. In use, the distal end or forward discharge end 60 of the center nozzle is located within the premix tube 46 but relatively close to the distal or forward end thereof.

Inlet(s) 62 are also defined in the proximal end 52 of the nozzle for premix gas fuel. The premix gas passage(s) 64 communicate with a plurality of radial fuel injectors 66, each of which is provided with a plurality of fuel injection ports or holes 68 for discharging premix gas fuel into a premix zone located within the premix tube 46.

Figure 4:
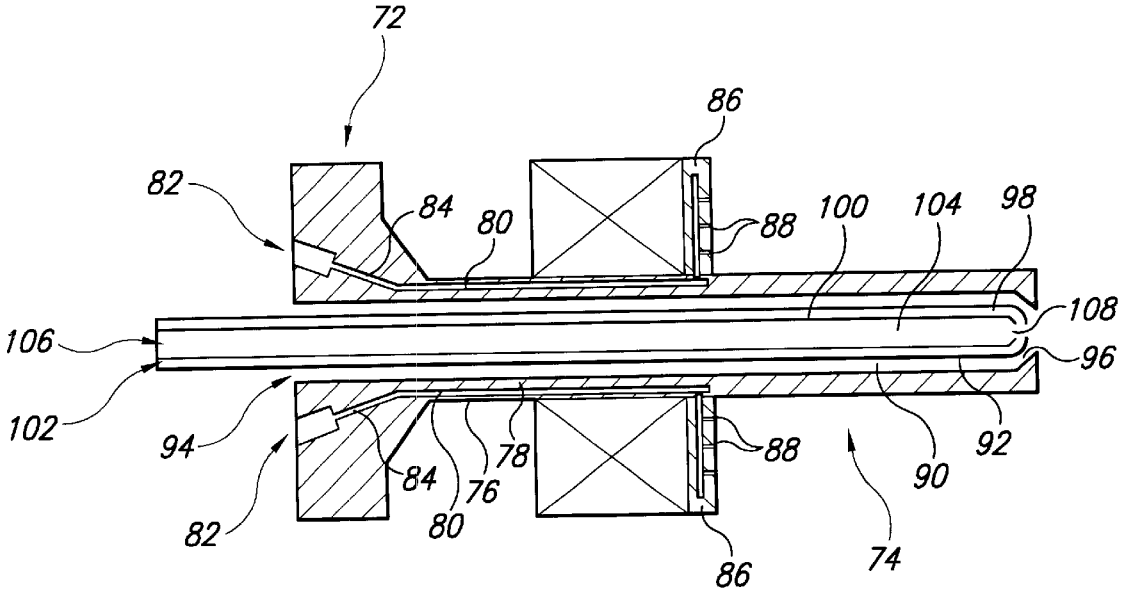
FIG. 4 is a schematic cross-sectional view of an outer fuel nozzle embodying the invention.

Referring to FIGS. 2, 3 and 4, each outer fuel nozzle assembly 32 includes a proximal end or rearward supply section 72, with inlets for receiving liquid fuel, water injection, atomizing air, and premix gas fuel, and with suitable connecting passages for supplying each of the above-mentioned fluids to a respective passage in a forward or distal delivery section 74 of the fuel nozzle assembly.

In the illustrated embodiment, the forward delivery section of the outer fuel nozzle assembly is comprised of a series of concentric tubes. Tubes 76 and 78 define premix gas passage(s) 80 which receive(s) premix gas fuel from premix gas fuel inlet(s) 82 in rearward supply section 72 via conduit 84. The premix gas passages 80 communicate with a plurality of radial fuel injectors 86 each of which is provided with a plurality of fuel injection ports or holes 88 for discharging gas fuel into the premix zone located within the premix tube 46. As described above with reference to the center nozzle 33, the injected premix fuel mixes with air reverse flowed from the compressor.

A second passage 90 is defined between concentric tubes 78 and 92 and is used to supply atomizing air from atomizing air inlet 94 to the burning zone 70 of the combustor via orifice 96. A third passage 98 is defined between concentric tubes 92 and 100 and is used to supply water from water inlet 102 to the burning zone 70 to effect NOx reductions in the manner understood by those skilled in the art.

Tube 100, the innermost of the series of concentric tubes forming the outer nozzle 32, itself forms a central passage 104 for liquid fuel which enters the passage via liquid fuel inlet 106. The liquid fuel exits the nozzle by means of a discharge orifice 108 in the center of the nozzle assembly 32. Thus, all outer and the center gas nozzles provide premix gaseous fuel. The center nozzle, but not the outer nozzles, provides gaseous diffusion fuel, and each of the outer nozzles, but not the center nozzle, is configured for delivering liquid fuel, water for emissions abatement, and atomizing air.

In the presently preferred embodiment of the invention, the machine operates on gaseous fuel in a number of modes. The first mode supplies diffusion gaseous fuel to the center nozzle 33, only, for acceleration of the machine and very low load operation. As the unit load is further raised, premix gaseous fuel is supplied to the outer gas nozzles 32. At approximately 40% load, the center nozzle 33 diffusion fuel is turned off and that percentage of the fuel is redirected to the outer gas nozzles. From 40 to 50% load, fuel is supplied exclusively to the outer premixed and quaternay nozzles. At approximately 50% load, the center nozzle 33 is turned on again to deliver premix gaseous fuel through the premix gas fuel passage(s) 64. This mode is applied with controlled fuel percentages to the premix gas nozzles up to 100% of the rated load. Actual percentages of fuel flow to the premixed nozzles are modulated to optimize emissions, dynamics, and flame stability. Liquid fuel is supplied through the outer fuel nozzles across the entire range of operation. Atomizing air is always required when operating on liquid fuel. Water injection for emissions abatement is required when operating on liquid fuel from approximately 50% up to full load.

Figure 6:
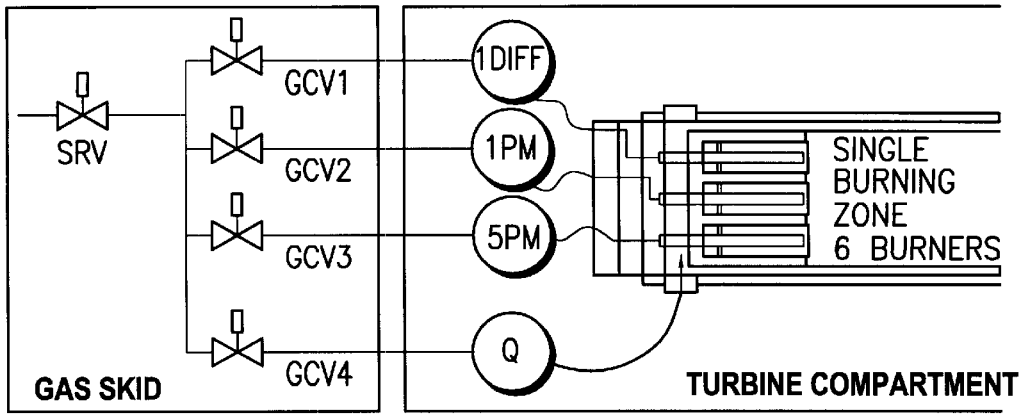
FIG. 6 is a schematic illustration of a gas fuel control system embodying the invention.

FIG. 6 shows the control system for use with gaseous fuel. Diffusion gas flow to the center nozzle is referred to as "1DIFF". Premix gas flow to the center nozzle 33 is referred to as "1PM", and premix gas flow to the outer nozzles 32 is referred to as "5PM". A fourth gas fuel circuit which does not involve the endcover 30 or fuel nozzles 32, 33 is commonly used for control of combustion dynamics. This circuit is labeled "Q" for quaternary fuel. A total of five gas fuel valves are used. The first of these is the Stop Speed Ratio Valve (SRV). This valve functions to provide a predetermined reference pressure for the downstream Gas Control Valves which function to distribute gas fuel to the proper location.

Figure 7:
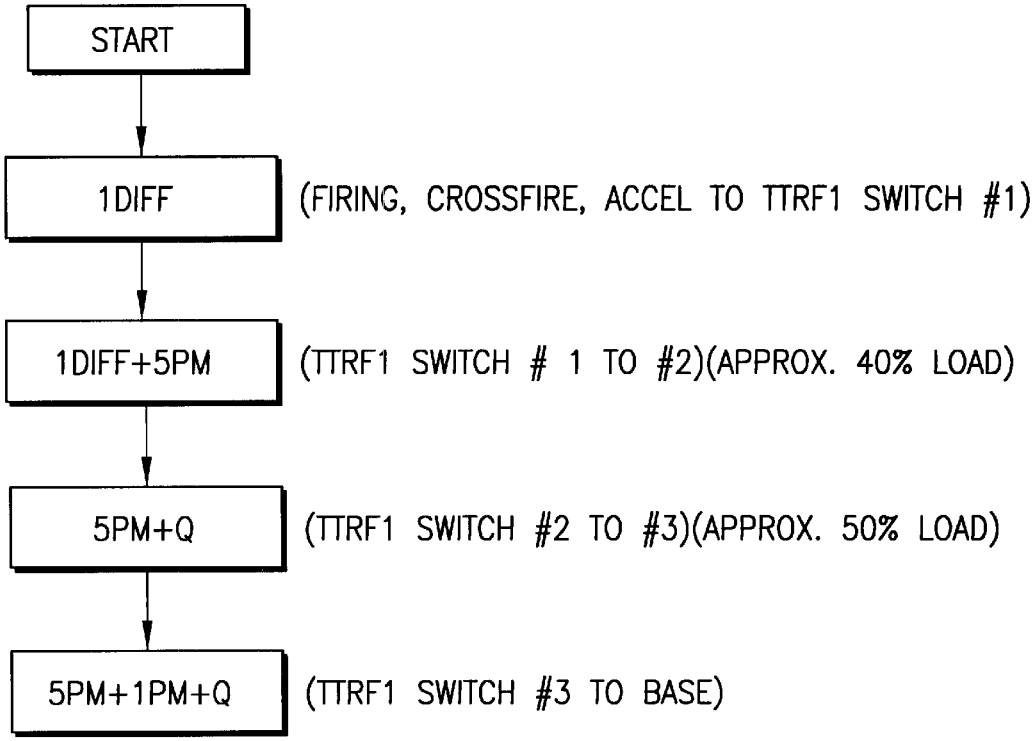
FIG. 7 is an illustration of the unit operation sequence of a presently preferred embodiment of the invention.

The unit is operated over the load range according to the sequence shown in FIG. 7. The unit ignites, cross-fires, and accelerates to full speed-no load (FSNL) with diffusion fuel to the center diffusion nozzle 33. From this point, the unit continues to operate in diffusion mode up to a point designated as TTRF1 switch #1. The quantity TTRF1 refers to a combustion reference temperature used by the control system. This variable is often referred to as firing temperature. At the switch point, premix gaseous fuel is initiated to the outer 5 premix nozzles 32 for the purpose of reducing emissions of NOx and CO. The unit is loaded in this mode through a set point defined by TTRF1 switch #2. Here, gas fuel is discontinued through the center diffusion nozzle. An air purge of the center diffusion nozzle is initiated to provide cooling of the nozzle tip and prevent ingestion of combusting gases into the diffusion fuel nozzle. At a point defined by TTRF1 switch #3, gaseous fuel is initiated to the premixed passage of the center nozzle. The unit is loaded to maximum power output in this mode. The unit down-loads by following the reverse path.

Oil operation is less complex. The unit can ignite, cross-file and accelerate to FSNL on fuel oil. From FSNL, the unit is typically operated up to 50% load without diluent injection for emissions control. A flow of atomizing air is always required when operating on liquid fuel. As each of the liquid fuel, water injection, and atomizing air passages face the flame, each of these passages require an air purge when not in use.

The above-described staging strategy eliminates the usual requirement for a diffusion gas passage in the outer (5PM) nozzles. Moreover, there is no need for liquid fuel flow in the center nozzle. This further eliminates the need for water injection and atomizing air to the center nozzle. As a result, the system and method of the invention does not require a piping system or valving for diffusion gas to the outer gas nozzles, nor does it require a piping system or valving for center liquid fuel, center water injection, or center atomizing air.

As will be appreciated from the foregoing description, the invention provides a compact means for configuring and operating an industrial gas turbine on gaseous and/or liquid fuels while utilizing fuel staging to achieve very low emissions on gaseous fuel.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of operating a combustor wherein the combustor has a plurality of outer fuel nozzles in an annular array arranged about a center axis and a center nozzle located on the center axis, and wherein the annular array is selectively supplied with premix fuel, liquid fuel, water and atomizing air, and further wherein the center nozzle is selectively supplied with diffusion fuel and premix fuel, the method comprising the steps of:

a) at start-up, supplying the center fuel nozzle with diffusion fuel;

b) as the unit load is raised, supplying premix fuel to at least one of the outer nozzles in the annular array;

c) at part load, ceasing diffusion fuel flow to the center nozzle and redirecting a corresponding percentage of fuel to at least one of the outer nozzles in the annular array, thereby to maintain fuel flow constant;

d) after load is further increased, initiating premix fuel supply to the center nozzle without adding to the supply of premix fuel to the outer fuel nozzles in the annular array; and then e) selectively supplying additional premix fuel to all of the fuel nozzles in the annular array and to the center nozzle as the turbine load increases.

2. The method of claim 1, wherein each fuel nozzle in the annular array of outer nozzles includes an air swirler for swirling air passing through the combustor, and wherein, during steps b), d), and e), premix fuel is supplied to the annular array of outer nozzles at locations upstream of said air swirlers and discharged from said outer nozzles downstream of said air swirlers.

3. The method of claim 2, wherein each of said outer nozzles in the annular array of outer nozzles has at least one premixed gas passage connected to at least one premix gas inlet and communicating with a plurality of radially extending premix fuel injectors disposed within a dedicated premix tube and wherein during steps (b), (d), and (e), premix fuel is supplied to said at least one premix gas passage and discharged through said plurality of radially extending premix fuel injectors, whereby premix fuel and combustion air is mixed in said dedicated premix tube prior to entry into a combustion zone disposed downstream of the premix tube.

4. The method of claim 1, wherein said outer fuel nozzles each include a central fuel passage and a water passage encircling said central fuel passage and further comprising the step of discharging water from said water passage into a combustion zone downstream of said outer fuel nozzles.

* * * * *

UNITED STATES PATENT AND TRADEMARK OFFICE

CERTIFICATE OF CORRECTION

PATENT NO. : 6,598,383 B1
DATED : July 29, 2003
INVENTOR(S) : Vandervort et al.

It is certified that error appears in the above-identified patent and that said Letters Patent is hereby corrected as shown below:

Title page,
Item [54], Title should be -- METHOD FOR STAGING FUEL FOR GAS TURBINES UTILIZING BOTH GASEOUS AND LIQUID FUELS --

Signed and Sealed this

Eighteenth Day of November, 2003

JAMES E. ROGAN
*Director of the United States Patent and Trademark Office*